US008881929B2

(12) United States Patent
Ekkert

(10) Patent No.: US 8,881,929 B2
(45) Date of Patent: Nov. 11, 2014

(54) TWO-PIECE CLOSURE FOR USE IN HOT-FILL CONTAINERS

(75) Inventor: Len Ekkert, Lemont, IL (US)

(73) Assignee: Phoenix Closures, Inc., Naperville, IL (US)

( * ) Notice: Subject to any disclaimer, the term of this patent is extended or adjusted under 35 U.S.C. 154(b) by 273 days.

(21) Appl. No.: 13/105,692

(22) Filed: May 11, 2011

(65) Prior Publication Data

US 2012/0285965 A1 Nov. 15, 2012

(51) Int. Cl.
*B65D 53/04* (2006.01)
*B65D 43/02* (2006.01)

(52) U.S. Cl.
CPC .. *B65D 43/0231* (2013.01); *B65D 2543/00537* (2013.01); *B65D 2543/0024* (2013.01); *B65D 2543/00981* (2013.01); *B65D 2543/00407* (2013.01); *B65D 2543/00296* (2013.01); *B65D 2543/00527* (2013.01); *B65D 2543/00092* (2013.01)
USPC ..... 220/304; 220/256.1; 220/255.1; 220/254.2; 220/254.1; 215/350; 215/343; 215/341; 215/232

(58) Field of Classification Search
CPC ..... B65D 2543/00092; B65D 2543/0024; B65D 2543/00296; B65D 2543/00521; B65D 2543/00537; B65D 41/00; B65D 41/0435; B65D 41/045; B65D 51/00; B65D 51/14; B65D 51/145; B65D 51/16; B65D 51/1688; B65D 51/20
USPC ..... 220/254.1–254.2, 254.7, 254.9, 255.1, 220/256.1, 304; 215/274, 276, 307, 309, 215/341, 343–345, 349–351
See application file for complete search history.

(56) References Cited

U.S. PATENT DOCUMENTS

| | | | | |
|---|---|---|---|---|
| 697,681 | A | | 4/1902 | Smelker |
| 2,041,403 | A | | 9/1932 | Fergusson |
| 2,040,798 | A | | 6/1934 | Schoonmaker |
| 2,135,834 | A | | 11/1938 | Overmyer |
| 2,383,747 | A | * | 8/1945 | Sharp ..... 215/276 |
| 2,424,801 | A | | 3/1946 | Crabbe et al. |
| 2,427,819 | A | * | 9/1947 | Thener ..... 215/276 |
| 3,042,247 | A | | 7/1962 | Bonnet |
| 3,059,800 | A | | 10/1962 | Mills |
| 3,110,599 | A | | 11/1963 | Kusinski et al. |
| 3,967,746 | A | | 7/1976 | Botkin |
| 4,003,489 | A | | 1/1977 | Bingaman |
| 4,042,143 | A | * | 8/1977 | Biggins ..... 220/256.1 |
| 4,121,729 | A | | 10/1978 | Husum |
| 4,122,964 | A | | 10/1978 | Morris |
| 4,174,784 | A | | 11/1979 | Hartung |

(Continued)

OTHER PUBLICATIONS

U.S. Office Action dated Apr. 11, 2013 for corresponding U.S. Appl. No. 13/105,718 (publication US 2012-0285959 A1, published Nov. 15, 2012).

(Continued)

*Primary Examiner* — Mickey Yu
*Assistant Examiner* — Brijesh V. Patel
(74) *Attorney, Agent, or Firm* — Husch Blackwell LLP

(57) ABSTRACT

A two-part closure for use in conjunction with a liner. An upper part of the closure is substantially plate like and clips or snaps onto the lower part of the closure. The lowest part of the closure has sidewalls with interior threads or a snap-on rib, as desired. The upper portion of the lower part is open, with crossing ribs positioned a spaced distance above the sealing lip for the lower part.

12 Claims, 4 Drawing Sheets

(56) References Cited

U.S. PATENT DOCUMENTS

| | | | | | |
|---|---|---|---|---|---|
| 4,319,690 | A | | 3/1982 | Birrell et al. | |
| 4,446,979 | A | | 5/1984 | Gach et al. | |
| 4,540,099 | A | * | 9/1985 | Swartzbaugh et al. | 215/252 |
| 4,765,499 | A | | 8/1988 | von Reis et al. | |
| 4,984,700 | A | * | 1/1991 | Knickerbocker | 215/251 |
| 5,062,538 | A | | 11/1991 | Ochs | |
| 5,092,477 | A | * | 3/1992 | Johnson et al. | 215/230 |
| 5,096,078 | A | | 3/1992 | McQueeny | |
| 5,169,003 | A | * | 12/1992 | Traupman | 206/524.8 |
| 5,251,809 | A | * | 10/1993 | Drummond et al. | 229/202 |
| 5,280,842 | A | | 1/1994 | Koo | |
| 5,297,696 | A | * | 3/1994 | Bernstein et al. | 222/83 |
| 5,381,918 | A | * | 1/1995 | Dahl | 220/784 |
| 5,839,592 | A | | 11/1998 | Hayes | |
| 5,927,530 | A | * | 7/1999 | Moore | 215/232 |
| 5,960,992 | A | * | 10/1999 | Bernstein et al. | 222/83.5 |
| 6,202,871 | B1 | | 3/2001 | Kelly | |
| 6,426,046 | B1 | | 7/2002 | Cassells et al. | |
| 7,611,026 | B1 | | 11/2009 | Bloom et al. | |
| 7,721,901 | B1 | | 5/2010 | Von Spreckelsen et al. | |
| 7,780,024 | B1 | | 8/2010 | Marsella et al. | |
| 7,798,319 | B1 | | 9/2010 | Bried et al. | |
| 7,832,579 | B2 | | 11/2010 | Lohrman et al. | |
| 7,938,282 | B1 | * | 5/2011 | Hawry et al. | 215/305 |
| 8,474,634 | B1 | | 7/2013 | Branson et al. | |
| 2002/0079286 | A1 | * | 6/2002 | Haynes et al. | 215/276 |
| 2002/0088811 | A1 | * | 7/2002 | Lu | 220/780 |
| 2004/0084452 | A1 | * | 5/2004 | Hsieh | 220/256.1 |
| 2005/0236413 | A1 | * | 10/2005 | Maciag et al. | 220/256.1 |
| 2005/0284837 | A1 | | 12/2005 | Taber et al. | |
| 2006/0091099 | A1 | | 5/2006 | Klepac et al. | |
| 2007/0034593 | A1 | * | 2/2007 | Ichimura et al. | 215/307 |
| 2007/0187352 | A1 | * | 8/2007 | Kras et al. | 215/276 |
| 2008/0302752 | A1 | | 12/2008 | Farrar et al. | |
| 2009/0218351 | A1 | | 9/2009 | Antal, Sr. | |
| 2010/0147848 | A1 | | 6/2010 | Rider et al. | |
| 2010/0187245 | A1 | | 7/2010 | Brown | |

OTHER PUBLICATIONS

U.S. Office Action dated Oct. 9, 2013 for corresponding U.S. Appl. No. 13/105,718 (publication US 2012-0285959 A1, published Nov. 15, 2012).

U.S. Office Action dated May 6, 2014 for corresponding U.S. Appl. No. 13/105,718 (publication US 2012-0285959 A1, published Nov. 15, 2012).

U.S. Office Action dated for Jul. 8, 2014 corresponding U.S. Appl. No. 13/105,718 (publication US 2012-0285959 A1, published Nov. 15, 2012).

U.S. Final Office Action dated Aug. 14, 2013 for corresponding U.S. Appl. No. 13/105,718 (publication US 2012-0285959 Al, published Nov. 15, 2012).

U.S. Final Office Action dated Jan. 31, 2014 for corresponding U.S. Appl. No. 13/105,718 (publication US 2012-0285959 Al, published Nov. 15, 2012).

U.S. Office Action dated Oct. 22, 2013 for corresponding U.S. Appl. No. 13/527,255 (publication US 2013-0334225 A1, published Dec. 19, 2013).

U.S. Office Action dated Aug. 14, 2013 for corresponding U.S. Appl. No. 13/527,255 (publication US 2013-0334225 A1, published Dec. 19, 2013).

U.S. Office Action dated Apr. 11, 2013 for corresponding U.S. Appl. No. 13/527,255 (publication US 2013-0334225 Al, published Dec. 19, 2013).

U.S. Notice of Allowance dated Jun. 10, 2014 for corresponding U.S. Appl. No. 13/527,255 (publication US 2013-0334225 A1, published Dec. 19, 2013).

* cited by examiner

TWO-PIECE CLOSURE FOR USE IN HOT-FILL CONTAINERS

BACKGROUND OF THE INVENTION

1. Field of the Invention

The present invention relates generally to container closures, and more particularly to closures with liners for use in hot-fill containers.

2. Background of the Invention

When hot-filling a container, the container is capped when the contents are at an elevated temperature. The container is manipulated to ensure the hot contents eliminate any biological contaminants in the container. At the elevated temperature, the container bulges. When the contents cool, the volume of any gas in the container is reduced, which can cause the bulging container to flex inwardly slightly past its original blown dimensions. When the product requires that a liner be used, additional risks are encountered with hot-fill contents. When the contents cool, the liner may be pulled inwardly sufficiently to break the seal about the mouth sealing surface.

Further, the liner may retain water on top, for example, when the container is sprayed as a part of the cooling process. Retained water may then run out from the liner when the customer tears it off.

Also, the retained water may support the growth of bacteria on the liner as mold, which would present the consumer with an unsightly and an unsanitary situation on opening the food container for the first time.

SUMMARY OF THE INVENTION

In accordance with the present invention, there is provided a two part closure for use in conjunction with a liner. An upper part of the closure is substantially plate like and clips or snaps onto the lower part of the closure. The lower part of the closure has sidewalls with interior threads or a snap-on rib, as desired. The upper portion of the lower closure part is open, with at least one rib positioned a spaced distance above the liner, which is held in place by a circumferential downward facing sealing lip of the lower closure part. When in place on a container, the rib serves to limit the travel of the liner upward as it expands after the hot-fill of a product, thereby helping to maintain the seal of the liner on the container mouth, while allowing for moisture to be blown away after the subsequent cooling step where the container may be sprayed with water.

BRIEF DESCRIPTION OF THE DRAWINGS

The present invention will be more readily apparent from the following detailed description of the invention and the appended claims, when taken in conjunction with the accompanying drawings in which:

DETAILED DESCRIPTION OF THE PREFERRED EMBODIMENTS

Figure 1:
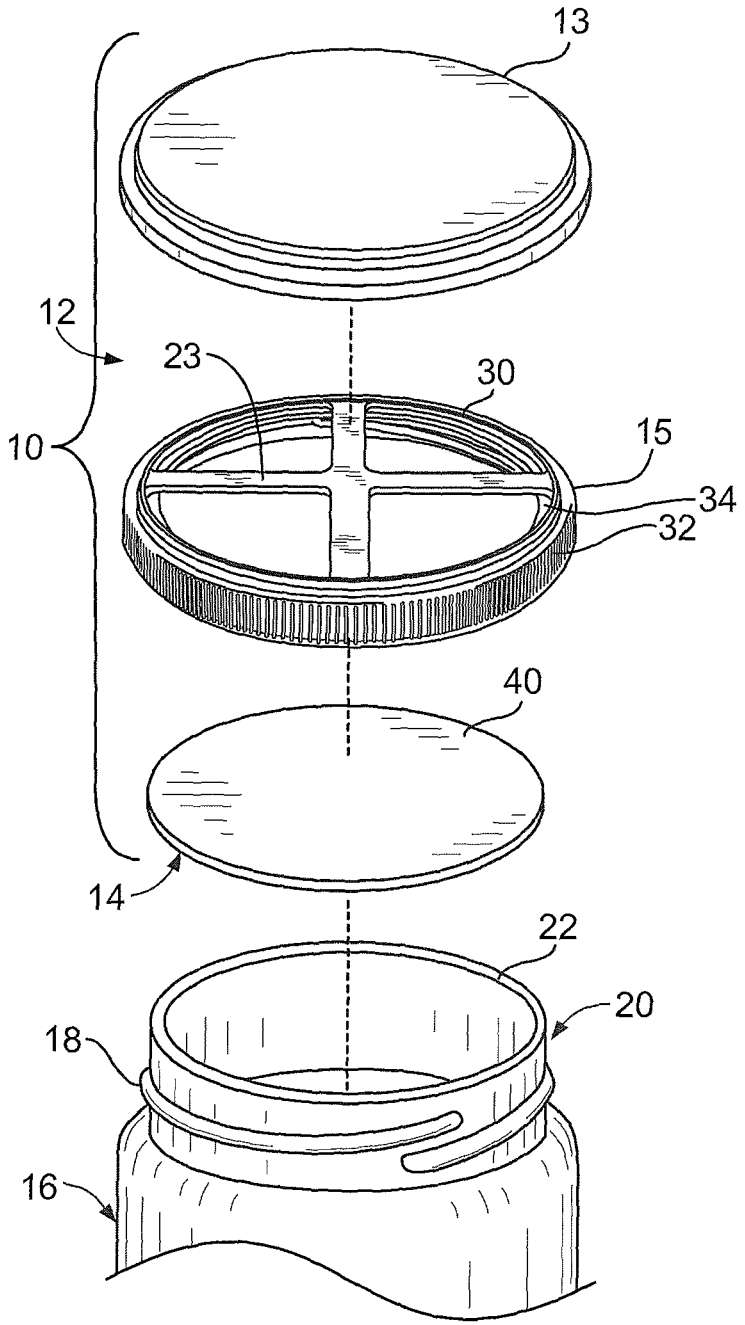
FIG. 1 is an exploded perspective view of a closure, liner and an associated container in accordance with the subject invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

Referring now to the figures and particularly to FIG. 1, there is shown a closure 10 including a closure 12 and a liner 14 in a typical container cap and liner. The closure is formed of two portions, upper portion 13 and lower portion 15. The closure 10 is for use with an associated container 16. The exemplary container 16 has container threads 18 with a finish 20. The finish 20 is that portion of the container 16 including the upper region which engages the cap 12, e.g., the container threads 18 and an uppermost sealing surface 22 of the container 16. The container threads 18 engage complementary threads 36 (FIG. 2) formed on an inner surface of the lower portion of the closure 15. It will be recognized by those skilled in the art that the closure package 10 described herein can also be used with containers having a snap-like or beaded engagement configuration.

The lower portion of the closure 15 has a top portion 30 with cross bars or ribs 23 positioned generally perpendicular to one another, although they may be at 70° to 110° to one another or parallel, as will be explained. A skirt portion 32 depends from the sealing surface 30. An upper portion 13 snap fits onto lower closure portion 15 and, when the two piece closure is on the container, seals the container. An inner shoulder 34 adjacent the skirt portion 32 is adapted to coact with the sealing surface 22 of the container 16 to form a seal therebetween, as will be seen. When the package is assembled, the liner 14 comprises a circular disc and resides between the inner shoulder 34 of the cap 12 and the sealing surface 22 of the container 16, spanning the mouth of the container 16. The sealing surface 22 presents a flat surface for sealing on the lower side, with a tapered surface 35 to the upper circumference of the lower portion (FIG. 6) as an aid in release of the part from the mold. Further, each rib tapers out at the juncture with the closure circumference as shown in FIG. 11, again, as an aid in release of the part from the mold.

Figure 6:
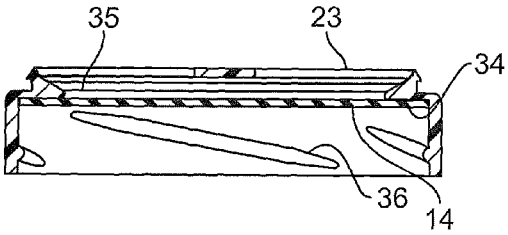
FIG. 6 is a partial cross-sectional view of the closure of the subject invention.
Figure 11:
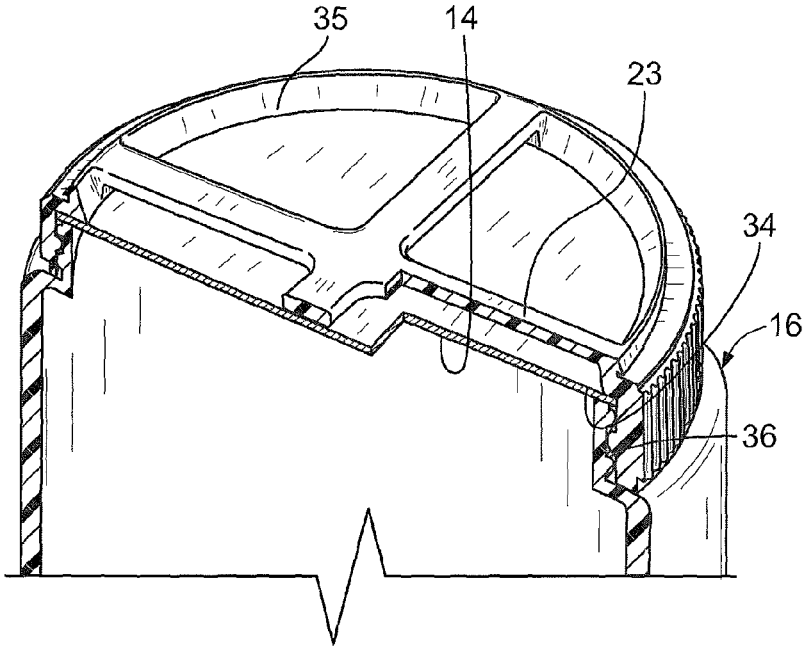
FIG. 11 is a cut-away view of the lower portion of the closure, a liner and the container.

The liner 14 has a central portion 40 that is positioned over and in use, sealed at its circumference to the sealing surface 22 of the container 16. In normal (room temperature) use, the liner remains spaced from the ribs, as seen in FIGS. 6 and 11.

In one embodiment the liner 14 is formed from a laminate material having a resilient substrate layer, a foil or like gas-impermeable layer, and a heat activated bonding layer, such as a heat activated adhesive. In a current embodiment, the resilient substrate layer is a closed cell foam material, but can be chip board or paper backed and/or coated and is relatively impervious to the environs and establishes a substantially air-tight seal between the container 16 contents and the environs. The resilient material layer permits the cap 12 to be closely fitted to, and tightened onto, the container 16.

In a process of filling and capping a container in a hot-fill process, the container is first filled with the hot product, and then a liner is placed over the mouth of the container and heat-sealed. While the product is still hot or warm, the air in the space above the product expands, pushing the liner outward. If there is nothing in place to contain the bulging liner, the seal of the liner on the mouth can be broken. Therefore the container is capped as soon as possible after the placement of the liner on the container and the closure is screwed or pressed down to maintain the liner in place and complete the seal. The container is then cooled by spraying with cold water, and the closure is placed on the container. If water is not completely blown off the liner before the cap is in place, there may be microbial and/or fungal growth on the liner when the ultimate user of the product opens the container. The discovery of such a condition by a consumer would result in ill will towards the retailer and the manufacturer, as well as result in decreased sales. Applicant's two piece closure will not only retain the outward bulge of the liner and thereby assist in maintaining the seal, but will also allow a blast of air to blow away any moisture which may have accumulated during the cooling process, thereby averting any microbial or fungal growth.

Figure 3:
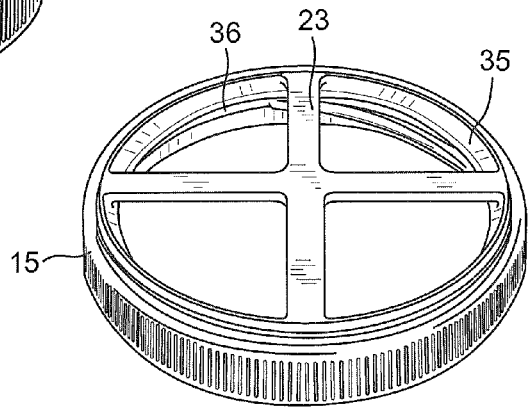
FIG. 3 is an upper perspective view of the bottom piece of the two piece closure of FIG. 1.
Figure 4:
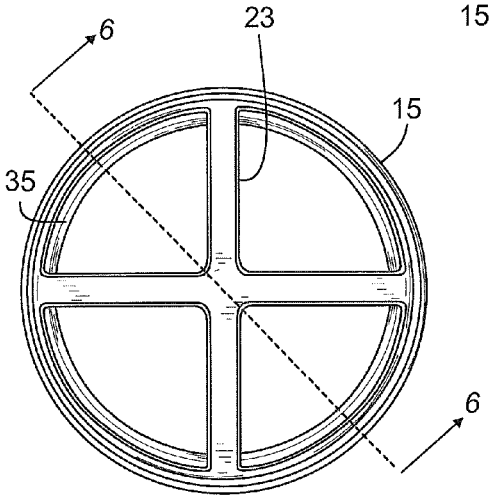
FIG. 4 is a top view of the bottom piece of the two piece closure of FIG. 1.
Figure 5:
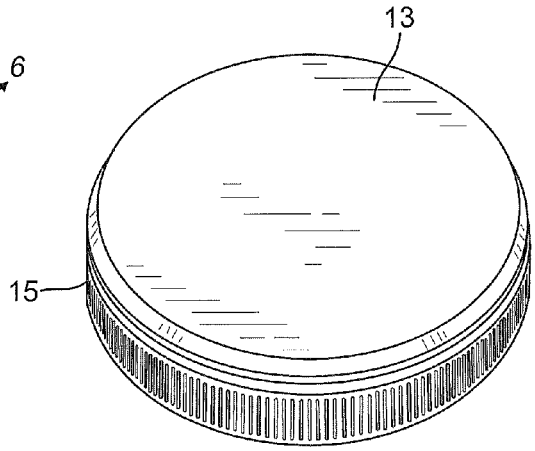
FIG. 5 is an upper perspective view of the two piece closure of FIG. 1 with both pieces shown together.

As shown in FIG. 3, the ribs are vertically spaced from the top of the liner when the liner is not under positive pressure from the product in the container. At least one rib, preferably two cross bars or ribs 23 extend across the lower closure portion 15. The ribs are attached to the upper portion of the lower portion 15 of the closure.

Thus the cross bars 23 are spaced 1 to 5 mm above the liner, thereby leaving sufficient open/upper space in the lower portion of the closure so that passage of the closure and container assembly past a blower will effectively eliminate moisture residing on the liner.

Figure 2:
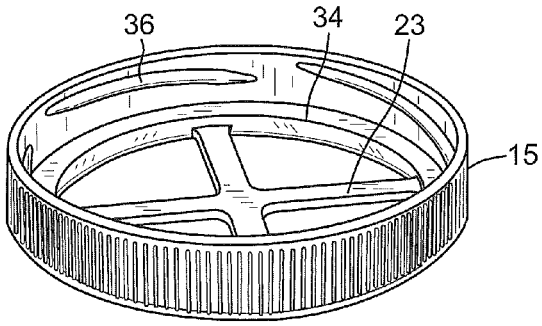
FIG. 2 is a bottom perspective view of the bottom piece of the two piece closure of FIG. 1.
Figure 7:
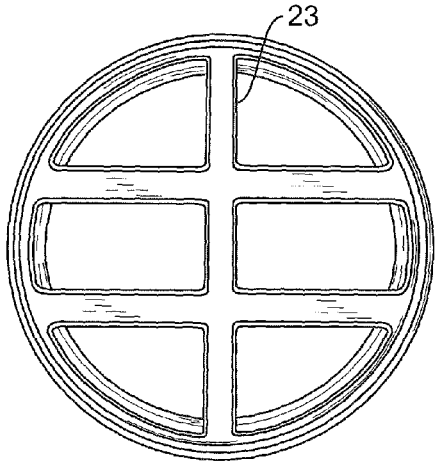
FIGS. 7, 8 and 9 are top views of alternate configurations of the bottom piece of the two piece closure of FIG. 1.
Figure 8:
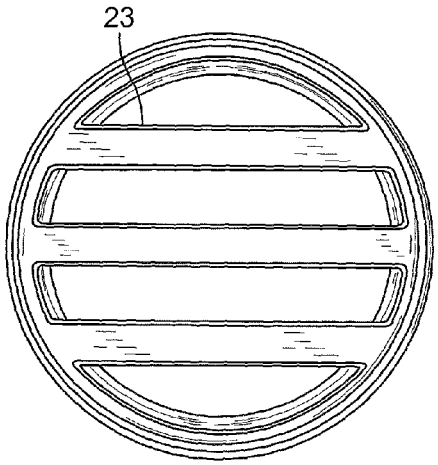
Figure 9:
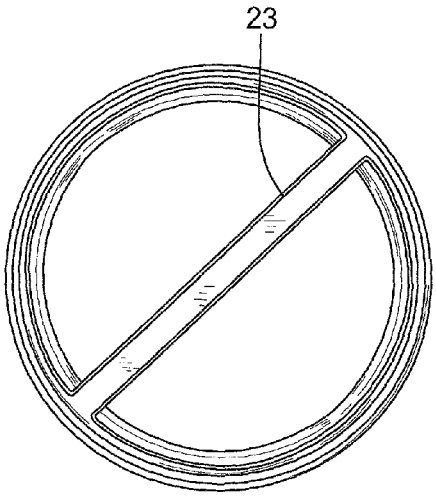
Figure 10:
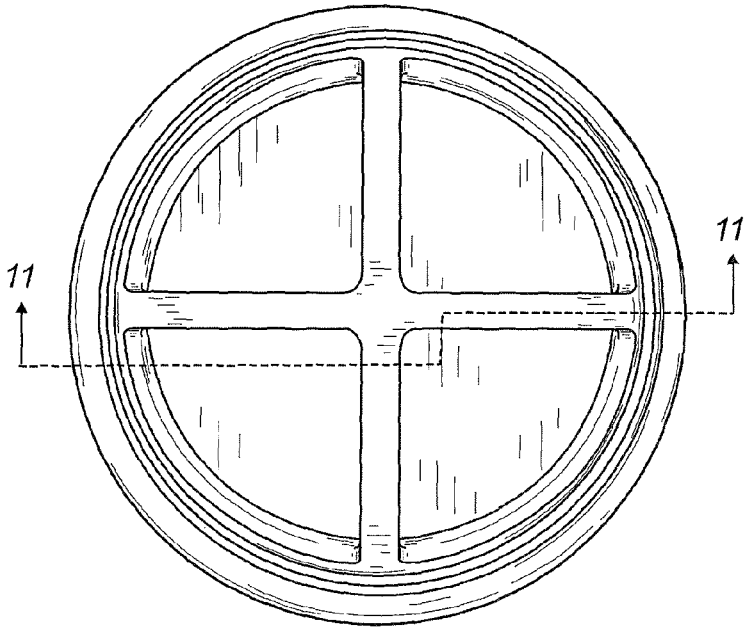
FIG. 10 is a top view of a portion of the closure, showing the liner beneath.

Instead of crossing ribs as shown in FIG. 2, other configurations, such as parallel (FIG. 8), grid (FIG. 7), or a single rib (FIG. 9) may be used.

It will be understood that the foregoing description is of preferred exemplary embodiments of the invention and that the invention is not limited to the specific forms shown or described herein. Various modifications may be made in the design, arrangement, and type of elements disclosed herein, as well as the steps of making and using the invention without departing from the scope of the invention as expressed in the appended claims.

The invention claimed is:

1. A closure and liner assembly for use with a container, comprising a two piece closure and a resilient liner, said two-piece closure comprising:

a lower portion having a sealing shoulder for pushing the resilient liner against a mouth of the container to effect a seal for sealing said the mouth of the container, said lower portion having an opening on an upper end and a crossbar spanning the opening;

an upper solid portion for covering said opening;

said crossbar being spaced from said resilient liner over the length of the crossbar, so that upon the application of heat to the container and expansion of said resilient liner upward, the crossbar allows only a limited travel of the expanding resilient liner upward while maintaining access to the resilient liner and maintaining said seal.

2. The closure and liner assembly of claim 1 wherein the resilient liner is a foil composite liner.

3. The closure and liner assembly of claim 1 wherein there are two crossbars disposed perpendicular to each other.

4. The closure and liner assembly of claim 1 wherein there are a plurality of crossbars disposed parallel to each other.

5. The closure and liner assembly of claim 1 wherein the crossbar is spaced from 1 to 5 mm above the plane of the resilient liner.

6. The closure and liner assembly of claim 1 wherein the upper solid portion snaps onto the lower portion.

7. A closure and liner assembly for use in conjunction with a container, said closure and liner assembly comprising a closure and a resilient liner, said closure comprising:

an upper section and a lower section, the lower section having an upper opening, said upper section covering said lower section to create a first seal for sealing said upper opening, the resilient liner covering a lower opening of the container and creating a second seal for sealing said lower opening, at least two crossbars spanning said upper opening of the lower section, said two crossbars being spaced from said resilient liner over the length of each crossbar to allow expansion upward with the application of heat to the container while said two crossbars limit the upward expansion of said resilient liner into said closure and thereby maintain the second seal of the resilient liner on the container.

8. The closure and liner assembly of claim 7 wherein said lower section has a shoulder, said shoulder pressing against said resilient liner for sealing said container.

9. The closure and liner assembly of claim 7 wherein said crossbars are disposed perpendicular to one another.

10. The closure and liner assembly of claim 7 wherein said crossbars are disposed parallel to one another.

11. The closure and liner assembly of claim 7 wherein the resilient liner is a foil composite liner.

12. The closure and liner assembly of claim 7 wherein the two crossbars are spaced 1 mm to 5 mm above the resilient liner.

* * * * *